US012779272B2

(12) United States Patent
Stegemann

(10) Patent No.: US 12,779,272 B2
(45) Date of Patent: Nov. 3, 2026

(54) NOISE REDUCTION WEIGHTLIFTING ACCESSORY

(71) Applicant: Quiet Lift Barbell Company LLC, Falmouth, ME (US)

(72) Inventor: Peter Stegemann, Falmouth, ME (US)

(73) Assignee: Quiet Lift Barbell Company LLC, Falmouth, ME (US)

( * ) Notice: Subject to any disclaimer, the term of this patent is extended or adjusted under 35 U.S.C. 154(b) by 51 days.

(21) Appl. No.: 18/897,576

(22) Filed: Sep. 26, 2024

(65) Prior Publication Data

US 2025/0099801 A1 Mar. 27, 2025

Related U.S. Application Data

(60) Provisional application No. 63/585,548, filed on Sep. 26, 2023.

(51) Int. Cl.
*A63B 21/072* (2006.01)

(52) U.S. Cl.
CPC ..... *A63B 21/0724* (2013.01)

(58) Field of Classification Search
CPC ..... A63B 21/072–0783
See application file for complete search history.

(56) References Cited

U.S. PATENT DOCUMENTS

| | | | | |
|---|---|---|---|---|
| 2,640,696 | A * | 6/1953 | Lemieux | A63B 21/0728 482/107 |
| 5,868,653 | A | 2/1999 | Klasen | |
| 9,623,276 | B1 * | 4/2017 | Deras | A63B 21/0724 |
| 11,666,793 | B2 | 6/2023 | Rothschild | |
| 2013/0109545 | A1 * | 5/2013 | Chen | A63B 21/0724 482/107 |
| 2014/0200119 | A1 | 7/2014 | Sides, Jr. | |
| 2015/0038302 | A1 * | 2/2015 | O'Brien | A63B 21/0724 482/107 |
| 2018/0001132 | A1 * | 1/2018 | Brown, Jr. | A63B 21/0728 |
| 2021/0178214 | A1 * | 6/2021 | Garcia | A63B 21/0724 |
| 2022/0054923 | A1 * | 2/2022 | Nock | A63B 21/072 |
| 2022/0161096 | A1 * | 5/2022 | Berg | A63B 21/0724 |
| 2023/0173325 | A1 * | 6/2023 | Garcia | A63B 21/4049 482/106 |

FOREIGN PATENT DOCUMENTS

| | | |
|---|---|---|
| DE | 19532254 | 10/1996 |

* cited by examiner

*Primary Examiner* — Megan Anderson
*Assistant Examiner* — Catrina A Letterman
(74) *Attorney, Agent, or Firm* — Caseiro Burke LLC; Nicholas A. McCrillis; Chris A. Caseiro

(57) ABSTRACT

The present invention is a noise reducing barbell sleeve. The barbell sleeve has a non-metallic outer sleeve which reduces the vibrations and sound created by the weights contacting the barbell sleeve during weightlifting activities. The barbell sleeve may be used with existing barbell bars and existing weights.

4 Claims, 5 Drawing Sheets

NOISE REDUCTION WEIGHTLIFTING ACCESSORY

BACKGROUND OF THE INVENTION

1. Field of the Invention

The present invention relates to a noise-reduction weightlifting accessory. More specifically, the present invention relates to a non-metal barbell accessory. Still more specifically, the present invention relates to a non-metal sleeve, which may be used in conjunction with barbells and other weightlifting apparatuses which reduces the noise created during weightlifting activities.

2. Description of the Prior Art

There currently exists a wide variety of workout accessories suited for various activities, functions, and types of workouts. One such item is a barbell. A barbell is a type of exercise equipment used in weightlifting and bodybuilding. The barbell typically consists of a long bar or shaft with two ends which are equipped to receive and retain weights. The ends are typically called sleeves. Weights are added to the sleeves to obtain the desired weight and may be secured by clips, hooks, or other forms. Weights used with barbells have a hole in the middle to match the dimensions of the sleeve such that the weight may be placed and retained on the sleeve to prevent slipping or moving during exercise.

In most cases, the sleeves are of a specific dimension in order to accommodate the majority of weights. The typical dimensions of the barbell sleeve are about 50 millimeters (about 1.97 inches) in diameter and about 131 centimeters (about 51.5 inches) in length. The barbell shaft and barbell sleeve are typically made of steel, a steel alloy, or aluminum; however, some barbells are designed with materials to support bending or flexing of the shaft. In these embodiments, the sleeve is still formed of a rigid material (typically steel or steel alloy) to maintain the ability to retain and hold the weights. The weights may also be made of steel or steel alloy to provide structure and the desired weight. Many weights are made of these or other metallic materials. An inner diameter of a typical weight is larger than the outer diameter of the sleeve or barbell.

As the typical design of barbells and the associated weights consists primarily of metal or other hard materials and there is not a friction or tight fit between the weights and the sleeve/barbell, the areas where the barbell and the weights make sporadic or periodic contact by essentially bouncing against each other can create significant amounts of noise during exercise. Metal rubbing on metal, clanging, and vibrations between the metal components are typical noises from such exercises. The noise created by using barbells and weights during exercises, which some may consider to be undesirably excessive, has led some gyms, fitness centers, and athletic facilities to prohibit or discourage certain exercises like squats, deadlifts, and other exercises designed for use with barbells that may be dropped to the underlying surface, such as a floor or barbell support. Additionally, a home with a gym or workout facility is another place where loud noises may not be desirable. The noise may disrupt other nearby individuals, or not be conducive to performing such exercises in a home or apartment.

Currently, an individual seeking to perform such exercises must be sure to be in a space where the noise is not prohibited, not a distraction to others, or includes some sort of special dampening floor and/or walls. This detracts from the athlete's workout or focus or limits their ability to perform the exercises they desire. What is needed is a device or apparatus which allows an individual to perform certain exercises or workouts without distracting or disturbing others. To accomplish this, what is needed is a device which may be used with a barbell that stops or dampens noise made by the combination of barbell and weights. The device should best be equipped with specifications for complementary use with existing weightlifting equipment. Namely, the device should be able to be used as a replacement for the sleeves of a barbell and be equipped to receive and retain existing weights.

SUMMARY OF THE INVENTION

The present invention is a noise-reduction weightlifting sleeve. It is a goal of the present invention to provide a replacement for existing barbell sleeves. It is a goal of the prevent invention for the sleeve to fit with existing barbell bars to be attached in a manner similar to attachments for the existing metal sleeves. The sleeves of the present invention are made of a non-metal material designed to dampen the noise of metal weights making contact with the sleeves. The sleeve may be made of a plastic, rubber, foam, or other non-metal material, or combination thereof.

The sleeve of the present invention is equipped to receive and retain weights for use in weightlifting, powerlifting, and many other athletic activities that require a barbell. The barbell has two sleeves, one at each end of the barbell shaft, where the weights may be removably placed and securely retained. Each sleeve typically has a collar. The collar serves as a fitting for where the weights may be placed and rest up against to hold them in the desired location. Each sleeve may also have one or more sets of ball bearings or other method of allowing the sleeve to rotate around the barbell, such as bushings. The sleeve may also have an endcap. The endcap is typically a component configured to allow the weights to be placed on the sleeve easily. It may have a rounded or beveled edge to facilitate the adding and removing of weights. The endcap of the present invention further serves as a method of securing or detaching the sleeve from the barbell.

It is a goal of the present invention to provide a method in which an athlete can perform their desired workout activities without disturbing others with distracting or loud noises. The noise-reduction sleeve includes an outer sleeve made of a non-metal material which dampens the typical noise of metal weights sporadically contacting a metal barbell sleeve around which the weights are positioned. The outer sleeve may be made of a polyethylene, polypropylene, polyurethane, or other non-metal material. In weightlifting activities, the weights loaded onto a barbell will typically vibrate, rattle, or spin around the metal sleeve, resulting in loud, obnoxious, or abrasive noises. The non-metal outer sleeve of the invention has an outer diameter less than the inner diameter of the weights. That allows movement of weights on and off of the sleeve, but with the noise reduction/noise absorbing characteristics of the sleeve, it also allows the metal weights to spin on, bounce on, or make other contact with the outer sleeve while also absorbing energy that would otherwise cause loud noises by clanging, or metal-on-metal rubbing that would otherwise occur.

It is a goal of the present invention to fit existing barbells and weights that are typically used in gyms and other athletic facilities. Barbells are typically designed to be able to detach and replace the sleeves from the straight bar. The present invention is a noise-absorbing sleeve that can be used with existing barbells and weights. That is, the present invention has dimensions similar to those of existing barbell sleeves. In this manner, the present invention may be used with the straight bar of an existing barbell and may also be used with typical weights. As most weights are typically designed to fit around existing barbell sleeves, the present invention may be designed with an outer diameter of about 50 millimeters (about 1.97 inches) but not limited thereto.

The sleeve of the present invention has a collar, an inner sleeve component, an outer sleeve component, and an endcap. The collar of the present invention provides a backstop for the weights placed on the sleeve. As the collar has a greater diameter than the sleeve, the weights slide along the sleeve up to the collar, and then may be pinned between the collar and a clip, latch, or other device to secure the weights to the barbell. The collar may also be equipped with a ball bearing or bushing system allowing the sleeve to rotate around the straight bar. It is a goal of the present invention to have a collar which provides backstop support for both the weights and the noise reducing outer sleeve.

The inner sleeve component is connected to the collar and the endcap and provides stability within the sleeve. The inner sleeve component may be made of a metal or other material to provide support and structure to the sleeve. The inner sleeve component may also have a ball bearing system, bushing system, or other method allowing the sleeve to rotate around the straight bar. The inner sleeve component is fixedly or removably coupled to the outer sleeve component such that the outer sleeve component substantially covers the inner sleeve component. The outer diameter of the sleeve comprising the inner sleeve component and the outer sleeve component is arranged to ensure that typical existing weights can slide over it.

The outer sleeve component is a non-metallic material, such as polyethylene, polypropylene, polyurethane, or other such viscoelastic material, or combinations of such materials, which has energy absorbing characteristics greater than that of metal. The outer sleeve component serves as a buffer between the inner sleeve component and weights on the sleeve, while the inner sleeve component provides structural integrity for the sleeve. Optionally, the inner sleeve component may be made of something other than metal as long as it provides sufficient structural integrity for the sleeve to be removably retained on the barbell and to support weights of the sort to be expected for typical usage. The outer sleeve component material is selected to withstand repetitive activities and the loading and unloading of weights.

The endcap is a metal or non-metallic material which may be used to secure the inner and outer sleeve components in place as well as providing a loading point for weights. The outer sleeve component is secured to the inner sleeve component by sliding the outer sleeve component over the inner sleeve component until one end of the outer sleeve component is in contact with the collar. The endcap is placed and secured on the other end of the sleeve, which may be done with a friction fit or screwing onto the opposing end of the inner sleeve component. The outer diameter of the endcap substantially matches that of the outer diameter of the outer sleeve. Attachment of the endcap secures the outer sleeve component in place over the inner sleeve component. The endcap may also secure the inner sleeve component to the barbell. The endcap may be attached to the sleeve in a multitude of ways. In some embodiments, the endcap is attached by a threading which may be attached and removed by threading or unthreading the endcap. Alternatively, the endcap may be attached and removed with a snap ring. The endcap is configured to be of substantially the same diameter as the sleeve so that the sleeve is of a substantially uniform diameter from the collar to the end of the endcap. The endcap is configured with a beveled, rounded, or other type of end to facilitate easier loading and unloading of weights on the sleeve.

The present invention is a barbell sleeve which reduces or eliminates the metal clanging and other noises of typical barbells during exercise. In an embodiment of the present invention, the invention may be used as a replacement for existing barbell sleeves, to be used with the existing straight bar of the barbell, and existing weights. In other embodiments of the present invention, the barbell sleeve may be configured with other desired diameters and lengths to accommodate various types of bars and weights.

DETAILED DESCRIPTION OF THE INVENTION

Figure 1:
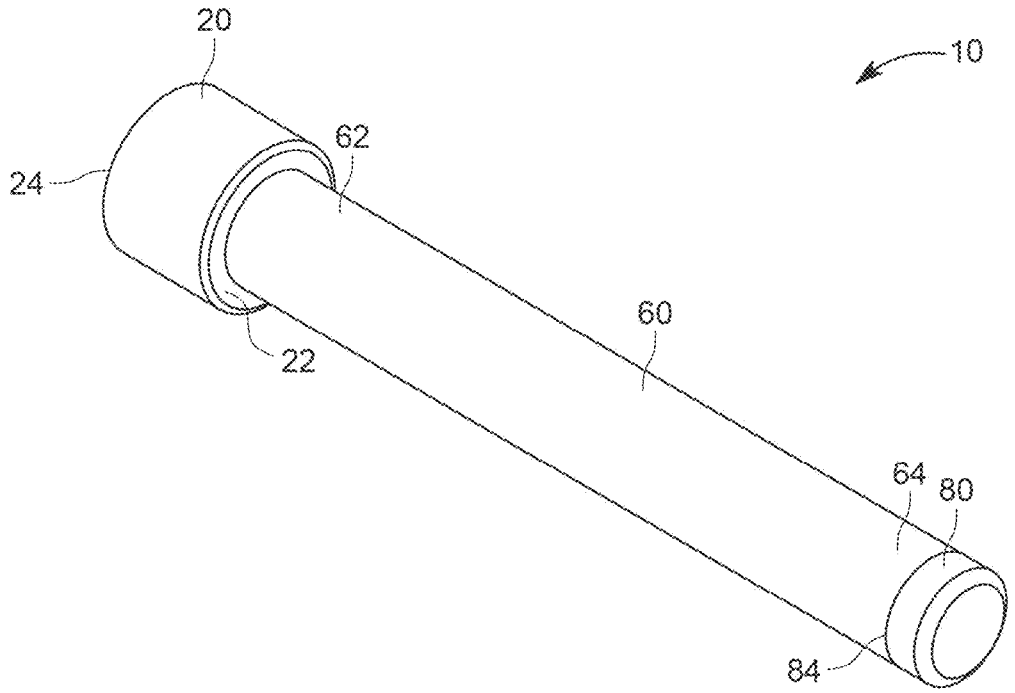
FIG. 1 is a top perspective view of the present invention.
Figure 2:
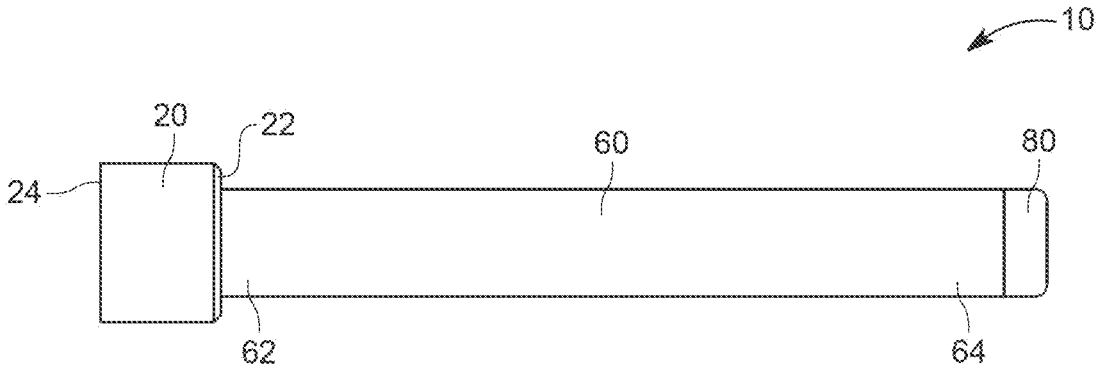
FIG. 2 is a side view of the present invention.
Figure 3:
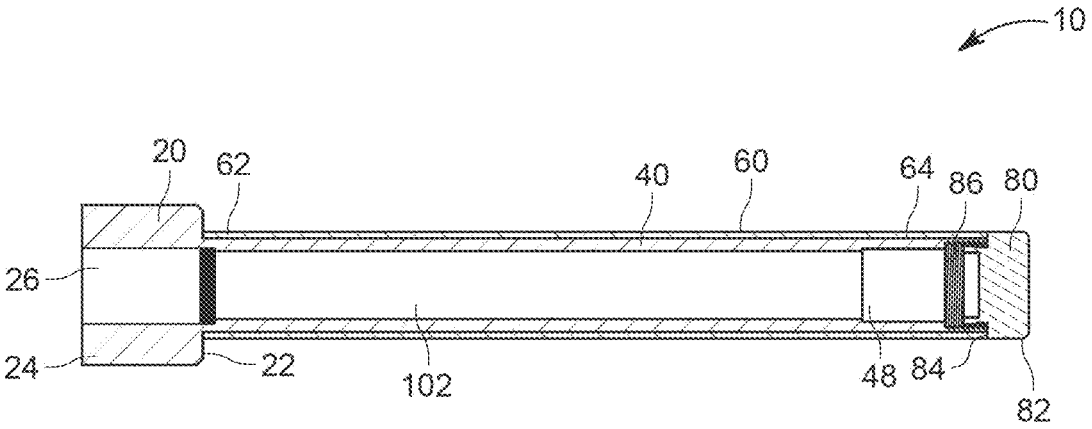
FIG. 3 is a cross-sectional side view of the present invention.

A barbell sleeve 10 of the present invention is shown in FIGS. 1-10. The sleeve 10 is depicted as a standalone barbell sleeve which may be attached to a bar. FIGS. 1-3 depict the barbell sleeve having all of the components of the sleeve. FIGS. 4-10 depict detailed views of the components of the device 10. The device 10 is designed to be used in a pair, and also in conjunction with a barbell bar 102. The barbell bar 102 is typically straight with two ends wherein the device 10 may be removably attached to either end. The device 10 facilitates the reception and retaining of weights, such that the user may utilize the barbell bar to lift the combined apparatus of the barbell bar 102, a first device 10 attached to one end of the bar 102, a second device 10 attached to the other end of the bar 102, and an optional selection of weights.

The barbell sleeve 10 has a collar 20, an inner sleeve component 40, an outer sleeve component 60, and an endcap 80. The collar 20 includes a first end 22, a second end 24, and a receiver 26. The inner sleeve 40 has a proximal end 42, a distal end 44, an internal structure 46, and a first link 48. The outer sleeve 60 has a primary end 62, a secondary end 64, and an inner space 66. The endcap 80 has a receiving edge 82, a retaining edge 84, and a second link 86.

FIG. 1 depicts the sleeve 10 as designed to be used. The outer sleeve 60 is in place over the inner sleeve 40. The outer sleeve 60 is held in place by the first end 22 of the collar 20 and the retaining edge 84 of the endcap 80. The endcap 80 is secured to the inner sleeve 40 to hold the inner sleeve 40 as well as the outer sleeve 60 in place on the bar. When used in weightlifting activities, weights are loaded and retained on the sleeve 10 during the activity. The outer sleeve 60 is made of a non-metal material selected to have energy absorbing characteristics sufficient to reduce the noise associated with weightlifting activities.

FIG. 2 is a side view of the barbell sleeve 10 with the outer sleeve 60 in place over the inner sleeve 40. To prevent the outer sleeve 60 from moving or sliding along the inner sleeve 40, the primary end 62 of the outer sleeve 60 is in contact with the first end 22 of the collar 22 and the secondary end 64 of the outer sleeve 60 is in contact with the retaining edge 84 of the endcap 80. The second end 24 of the collar 20 is configured to removably receive the barbell bar 102.

FIG. 3 is a cross-sectional side view of the device 10 showing the outer sleeve 60 around the inner sleeve 40. The inner sleeve 40 and the endcap 80 are connected by the first link 48 of the inner sleeve 40 and the second link 86 of the endcap 80. The first link 48 and the second link 86 may be connected by a snap ring, threading, or other method of attachment. The barbell bar 102 is inserted into the second end 24 of the collar 20 and traverses through the internal structure 46 of the inner sleeve 40. The internal structure 46 is equipped with a method of allowing the bar 102 to rotate within the internal structure 46 of the inner sleeve 40. This is typically accomplished using a system of ball bearings or bushings. The ball bearings or bushings system may be located within the collar 20. The ball bearings or bushings are designed to allow smooth, limited resistance rotation between the bar 102 and inner sleeve 40.

Figure 4:
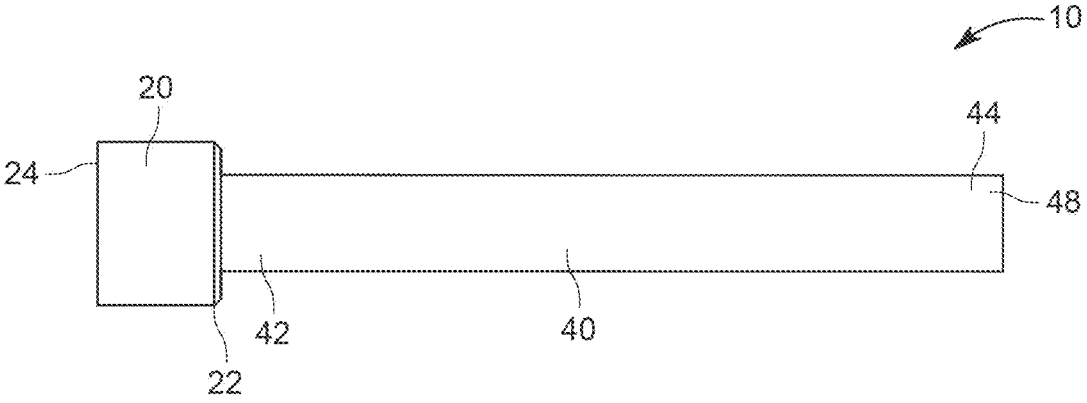
FIG. 4 is a side view of collar and the inner sleeve of the present invention.
Figure 5:
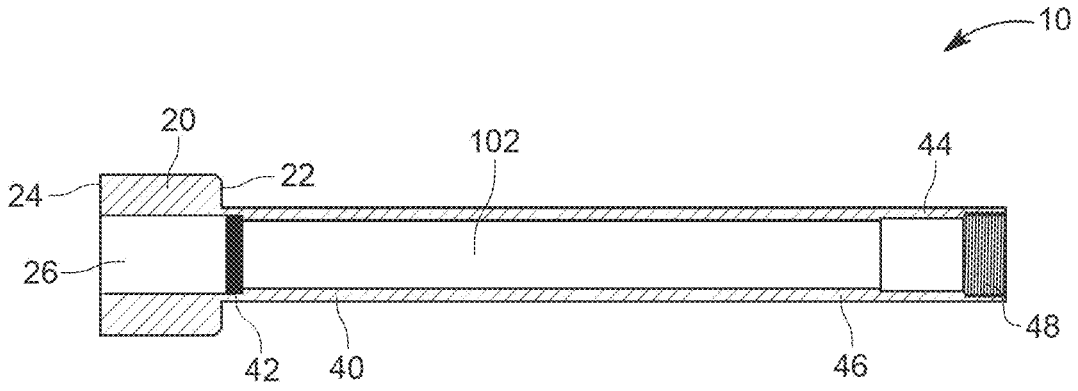
FIG. 5 is a cross-sectional side view of the collar and the inner sleeve of the present invention.

FIGS. 4-5 are side views of the sleeve 10 showing the collar 20 and the inner sleeve 40. The proximal end 42 of the inner sleeve 40 is connected to the first end 22 of the collar 20. The second end 24 of the collar 20 is configured to removably receive the bar 102. The distal end 44 of the inner sleeve 40 is configured to removably receive the endcap 80. The inner sleeve 40 is configured to receive the outer sleeve 60. Typically, the outer sleeve 60 is slid over the inner sleeve 40 from the distal end 44 to the proximal end 42. The outer sleeve 60 has a diameter configured to fit securely around the diameter of the inner sleeve 40. FIG. 5 is a cross-sectional side view of the sleeve 10 showing the collar 20 and the inner sleeve 40. The bar 102 traverses through the second end 24 of the collar 20 to the distal end 44 of the inner sleeve 40.

Figure 6:
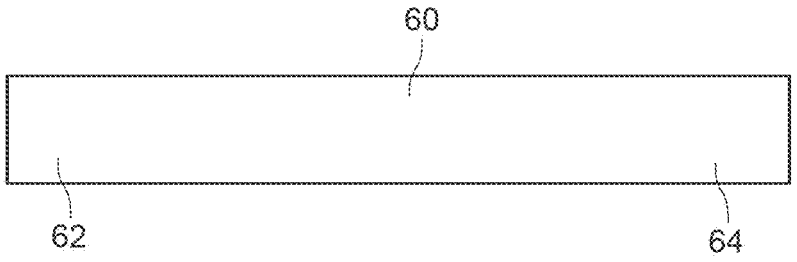
FIG. 6 is a side view of the outer sleeve of the present invention.
Figure 7:
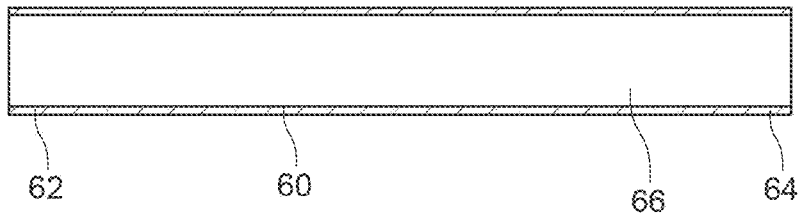
FIG. 7 is a cross-sectional side view of the outer sleeve present invention.

FIGS. 6-7 are side views of the outer sleeve 60. The outer sleeve 60 is made of a non-metal material, designed to absorb the contact between the weights and the inner sleeve 40. The inner space 66 of the outer sleeve 60 is designed to fit securely around the inner sleeve 40. The thickness of the outer sleeve 60 is such that the total outer diameter of the sleeve 10 combining the inner sleeve 40 with the outer sleeve 60 is less than the inner diameter of weights used on barbells, which inner diameter is about 50 millimeters (about 1.97 inches). In other embodiments of the present invention, the dimensions of each of the inner sleeve 40 and the outer sleeve 60 may vary with respect to one another so long as the total outer diameter of that combination allows for weights to fit over the sleeve 10. As noted, that total is about 50 millimeters. Alternatively, the outer diameter of the sleeve 10 may be different to accommodate bars 102 or weights of differing specifications, which also means that the dimensions of the inner sleeve component 40 and the outer sleeve component 60 may also be varied. FIG. 7 is a cross-sectional side view of the outer sleeve 60 depicting the primary end 62, the secondary end 64, and the inner space 66. The inner space 66 is designed to fit around the inner sleeve 40. The thickness of the outer sleeve 60 may vary depending on the inner sleeve 40 diameter and the desired noise reduction characteristics of the outer sleeve 60. The outer sleeve 60 may have a hardness durometer between 40 to 80. In an embodiment of the present device 10, the hardness durometer is about 65.

Figure 8:
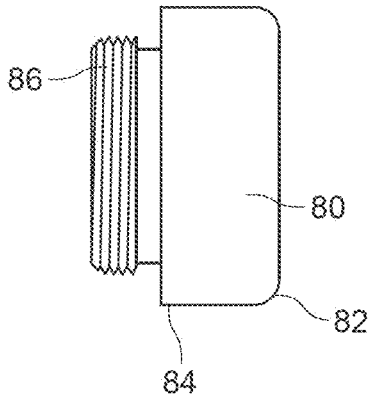
FIG. 8 is a side view of the endcap of the present invention.
Figure 9:
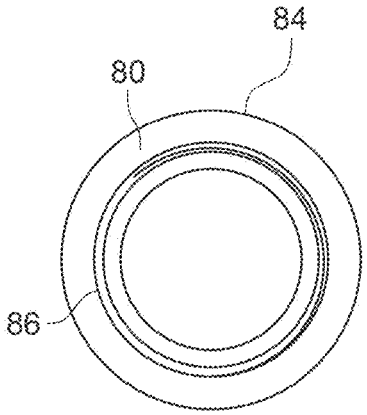
FIG. 9 is a front view of the endcap of the present invention.
Figure 10:
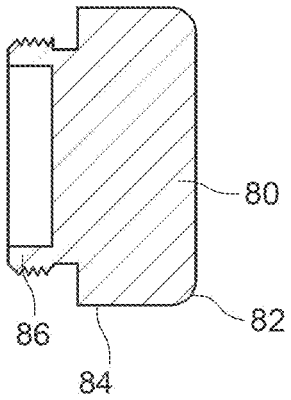
FIG. 10 is a cross-sectional side view of the endcap of the present invention.

FIGS. 8-10 depict the endcap 80 of the sleeve 10. The endcap 80 is designed to secure the outer sleeve 60 to the device 10. The outer sleeve 60 is positioned over the inner sleeve 40 and the endcap 80 is removably attached to the inner sleeve 40 to retain the outer sleeve 60 in place. It is noted that the outer sleeve component 60 is an annular structure so that the inner sleeve component 40 is located within it. The second link 86 of the endcap 80 is removably engaged with the first link 48 of the inner sleeve 40. Once engaged, the first link 48 and the second link 86 are secured in a fashion to retain the bar 102, the inner sleeve 40, and the endcap 80 together securely such that the sleeve 10 is able to withstand repetitive use, vibration, and contact during athletic activities. Once secured, the endcap 80 is able to receive weights from the receiving edge 82. Typically, the receiving edge 82 is beveled or otherwise configured to easily slide weights onto the sleeve 10. The retaining edge 84 is designed to be of equal diameter to that of the outer sleeve 60 such that weights may be easily slid over the endcap 80 along the outer sleeve 60 until the weights meet the first end 22 of the collar 20. In this fashion, the weights rest securely against the collar 20 during exercise.

FIG. 8 is a side view of the endcap 80. The endcap 80 is depicted with a receiving edge 84 that is rounded, tapered, or beveled. The receiving edge 84 allows for easier loading and removal of weights than a sharp or lipped edge. The retaining edge 82 of the endcap 80 is designed to be flush with the outer sleeve 60 such that weights may be easily loaded and unloaded over the endcap 80 and the outer sleeve 60 without catching on the outer sleeve 60 that otherwise has a greater outer diameter than the retaining edge 84 of the endcap 80 or with an outer sleeve 6 with a lesser diameter than the retaining edge 84 of the endcap 80. FIG. 9 is a front view of the endcap 80 depicting the retaining edge 84 and the second link 86. FIG. 10 is a cross-sectional view of the endcap 80 depicting the receiving edge 82, the retaining edge 84, and the second link 86. The embodiment of the present invention depicts the second link 86 of the endcap 80 as a threaded connector. The second link 86 of the endcap 80 and the first link 48 of the inner sleeve 40 may connect in a multitude of manners such as threading, a snap ring, or other forms of connections.

The dimensions of the present invention 10 may vary based on desired use with other workout equipment. In the present embodiment, the collar 20 may have a diameter of between about 70 millimeters and about 80 millimeters with a length of between about 50 millimeters and about 60 millimeters. The outer sleeve 60 may have a diameter of between about 45 millimeters and about 55 millimeters, a thickness of between about 5 millimeters and about 10 millimeters, and a length of about 360 millimeters and about 400 millimeters. The inner sleeve 40 may have a diameter of between about 40 millimeters and about 50 millimeters and a length of about 360 millimeters and about 400 millimeters. The dimensions of the components described herein are an example of an embodiment of the present invention 10. The dimensions of the components of other embodiments may vary.

The present invention has been described with reference to specific examples and configurations. The description is not to be taken in a limiting sense but is made merely for the purpose of illustrating the general principles of the invention, since the scope of the invention is best defined by the appended claims.

What is claimed is:

1. A barbell sleeve device, the barbell sleeve device comprising:

a collar having a first end, a second end, and a receiver, wherein the second end of the collar is configured to removably receive a barbell bar therein;

an inner sleeve component having a proximal end and a distal end;

an outer sleeve component having a primary end, a secondary end, and an inner space; and an end cap having a receiving edge and a retaining edge;

wherein the outer sleeve component is made of a non-metallic material with energy absorbing characteristics sufficient to reduce the noise associated with weight-lifting activities, wherein the inner sleeve component extends from the collar at the proximal end of the inner sleeve component to the end cap at the distal end of the inner sleeve component;

wherein the outer sleeve component is in position over the inner sleeve component such that the inner space of the outer sleeve component fits securely around the inner sleeve component from the proximal end of the inner sleeve component to the distal end of the inner sleeve component;

wherein the primary end of the outer sleeve component is held in place by the first end of the collar and the secondary end of the outer sleeve component is in contact with the retaining edge of the end cap to prevent the outer sleeve component from moving or sliding along the inner sleeve component, and wherein the end cap is secured to the inner sleeve component to hold the inner sleeve component and the outer sleeve component on the barbell bar.

2. The barbell sleeve device of claim 1 wherein the outer sleeve component is made of a polyethylene material.

3. The barbell sleeve device of claim 1 wherein the inner sleeve component and the outer sleeve component together form a combined outer diameter of about 50 millimeters.

4. The barbell sleeve device of claim 1 wherein a link of the inner sleeve is removably connected to a link of the end cap with a threading feature.

* * * * *